US010279819B2

(12) United States Patent
Koch et al.

(10) Patent No.: US 10,279,819 B2
(45) Date of Patent: May 7, 2019

(54) MOUNTING FOR A FRONT HATCH OF A CAR OF A TRAIN AND CAR OF A TRAIN

(71) Applicant: Dellner Couplers AB, Falun (SE)

(72) Inventors: Thilo Koch, Hamburg (DE); Norman Dix, Gaimersheim (DE)

(73) Assignee: Dellner Couplers AB, Falun (SE)

( * ) Notice: Subject to any disclaimer, the term of this patent is extended or adjusted under 35 U.S.C. 154(b) by 227 days.

(21) Appl. No.: 15/315,059

(22) PCT Filed: May 27, 2015

(86) PCT No.: PCT/EP2015/001079

§ 371 (c)(1),
(2) Date: Nov. 30, 2016

(87) PCT Pub. No.: WO2015/180838

PCT Pub. Date: Dec. 3, 2015

(65) Prior Publication Data

US 2017/0197640 A1 Jul. 13, 2017

(30) Foreign Application Priority Data

May 30, 2014 (EP) ..... 14001881

(51) Int. Cl.

| | |
|---|---|
| ***B61D 17/06*** | (2006.01) |
| ***B61D 49/00*** | (2006.01) |
| ***E05F 15/00*** | (2015.01) |

(52) U.S. Cl.

CPC ..... *B61D 49/00* (2013.01); *B61D 17/06* (2013.01); *E05F 15/00* (2013.01); *E05Y 2201/684* (2013.01); *E05Y 2900/51* (2013.01)

(58) Field of Classification Search

CPC ..... B61D 49/00; B61D 17/06; E05F 15/00
See application file for complete search history.

(56) References Cited

U.S. PATENT DOCUMENTS 8,468,953 B2 * 6/2013 Ahrens ..... B61D 17/06 105/1.1
8,757,066 B2 6/2014 Heinisch et al.
(Continued)

FOREIGN PATENT DOCUMENTS

CN 102310865 A 1/2012
CN 102933445 A 2/2013
(Continued)

OTHER PUBLICATIONS

International Search Report dated Aug. 26, 2015 for related PCT Application No. PCT/EP2015/001079.

*Primary Examiner* — Jason C Smith
(74) *Attorney, Agent, or Firm* — Howard IP Law Group

(57) ABSTRACT

An articulating mount for a moveable front hatch of a train car includes a linear actuator configured to be rotatably connected to the car at a first connection point. The linear actuator includes a moveable end configured to be connected to the front hatch at a second connection point, and is effective, when actuated, to change a distance between the first and second connection points. The mount further includes a first guide configured to be rotatably connected to the car. The first guide includes a guide rail defining an opening sized to receive a first protrusion connected to the front hatch for guiding movement of the moveable end of the linear actuator, responsive to actuation of the linear actuator, along a first guide path between a first position and a second position.

16 Claims, 3 Drawing Sheets

(56) References Cited

U.S. PATENT DOCUMENTS

| | | | | |
|---|---|---|---|---|
| 2010/0270813 | A1* | 10/2010 | Roth | B60R 21/38 292/121 |
| 2011/0296762 | A1* | 12/2011 | Ahrens | B61D 17/06 49/340 |
| 2012/0174818 | A1* | 7/2012 | Bremkamp | B61D 17/06 105/238.1 |
| 2013/0133547 | A1* | 5/2013 | Heinisch | B61D 17/00 105/413 |
| 2017/0197640 | A1* | 7/2017 | Koch | B61D 17/06 |
| 2017/0327074 | A1* | 11/2017 | Schabenberger | B62D 25/12 |

FOREIGN PATENT DOCUMENTS

| | | | | |
|---|---|---|---|---|
| CN | 202952986 | U | 5/2013 | |
| CN | 203567735 | U | 4/2014 | |
| DE | 4445182 | C1 | 12/1995 | |
| DE | 297 06 073 | U1 | 7/1997 | |
| DE | 10 2009 041445 | | 3/2011 | |
| DE | 102011076866 | A1 | 12/2012 | |
| EP | 2 394 879 | A1 | 12/2011 | |
| EP | 2394879 | A1 * | 12/2011 | B61D 17/06 |
| JP | 2000344101 | A | 12/2000 | |
| WO | 2007073273 | A1 | 6/2007 | |
| WO | 2011/154527 | A1 | 12/2011 | |
| WO | 2013149786 | A1 | 10/2013 | |

* cited by examiner

MOUNTING FOR A FRONT HATCH OF A CAR OF A TRAIN AND CAR OF A TRAIN

CROSS-REFERENCE TO RELATED APPLICATIONS

This application is a national phase application under 35 U.S.C. § 371 of International Patent Application No. PCT/EP2015/001079 filed May 27, 2015, which claims priority to European Application No. 14 001 881.3 filed May 30, 2014, the entire contents of all of which are incorporated herein by reference in their entireties for all purposes.

FIELD

The invention relates to a mounting for a front hatch of a car of a train as well as to a car of a train with a front hatch and a mounting for the front hatch as well as to a method for moving a front hatch of a car of a train from a first end position to a second end position.

BACKGROUND

From WO 2007/073273 A1 a mechanism for opening and closing a front hatch, which is retractable into the body of a railway vehicle, is known. In a closed position of the hatch, a coupler which is supported from the vehicle's chassis is covered behind the front hatch. Upon opening of the front hatch the coupler is uncovered in order to admit coupling to a connecting railway vehicle. The front hatch is described to comprise at least two separable sections that are pivotally supported on a cantilever beam which extends freely from the vehicle's chassis. According to the described mechanism, the front hatch sections are retractable inside the body in a linear motion once they are in a separated mode. The linear motion takes place along the cantilever beam.

The known mechanism makes it necessary that room is provided behind the coupler so that the hatch sections can be pulled behind the coupler in the linear motion for the open position. Additionally, the known mechanism has a certain degree of complexity due to the use of two hatch sections that have to be separated and moved around opposite sides of the coupler.

SUMMARY

Starting from this background, the problem to be solved by the invention is to provide a mounting for a front hatch of a car of a train that is more simple in design and reduces the space that needs to be hold available for taking up parts of the hatch in the open state.

This problem is solved by the mounting and the car of a train, as well as the method, described and illustrated herein.

The invention is based on the basic concept to attach the front hatch to an actuator at one end of the actuator and to connect the other end of the actuator directly to the car in such a manner that it allows the actuator itself to rotate (swivel) relative to this point of contact with the car. Given that the hatch is connected to the actuator, connecting the actuator to the car in manner that allows the actuator to rotate relative to the point of contact with the car at the same time allows the hatch to rotate around that point of contact with the car. However, since the actuator is arranged between the front hatch and the point of contact with the car and because the actuator can be actuated to increase the distance between the point of contact with the car (first point of connection) and the connection with the front hatch (second point of connection) the rotational path of the front hatch around the point of contact with the car can be influenced. Actuating the actuator to increase the distance between the first point of connection and the second point of connection thus increases the radius of the path along which the front hatch rotates around the point of contact with the car. This, for example, advantageously allows the hatch to be moved around a guiding horn of a coupler head (if such a guiding horn is present). Basically, it allows the clearance of the hatch relative to the coupler head to be increased for the rotational movement of the front hatch around the point of contact with the car.

In a preferred embodiment, the actuator can be actuated to change the distance between the first point of connection and the second point of connection while the front hatch is rotating around the first point of connection. This allows the radius of the rotational movement of the front hatch around the first point of connection to be reduced while the front hatch rotates (swivels) around the first point of connection. This allows for the rotational path of the front hatch around the first point of connection to take up the shape of a part of an ellipse or any other arc-type path with changing radius of curvature.

The mounting according to the invention has an actuator that can be connected to the point of contact of the car in a manner that allows the actuator to rotate relative to the point of contact, thereby defining a first point of contact of the actuator. Preferably, the connection between that end of the actuator and the car is provided by a bearing. Such a bearing can be a ball joint, which would allow the actuator to rotate about the first point of connection around more than one axis. In a different embodiment the connection can be a hinged joint (pin joint) which limits the rotation of the actuator relative to the point of contact to a rotation (to a swiveling) around one axis.

The actuator of the mounting of the invention is also connected to the front hatch, thereby defining a second point of connection of the actuator. In a preferred embodiment, the front hatch is a one-piece element and the actuator is connected to this one-piece element. Instead of using a one-piece element as a front hatch, embodiments are feasible where the front hatch is a multi-part hatch, for example a hatch that has at least two hatch sections. In such an embodiment, the actuator is connected to one of the hatch sections, while a further actuator might be provided that is connected to a second hatch section.

According to the invention, the first point and the second point of connection are distanced apart by a first distance in a first operational state of the mounting. This first operational state can, for example, be the state of the closed hatch. Hatches often are complex 3-dimensional objects, the outward facing surface of the hatch often being designed with respect to specific aerodynamic requirements, while at the same time having to be a shape that allows the hatch to cover at least parts of the coupler head. Additionally, the shape of the hatch can be influenced by its effect on the overall length of the train. Designs are known, where the front hatch has to be of a small overall length, for example for metro trains or regional trains, whereby other embodiments are known where the aerodynamics are more relevant and the front hatch can thus be of longer design, for example for high-speed trains. Given the above described influences on the shape of the front hatch, there will be many embodiments where in the closed state the front hatch will fit around the coupler head with minimal clearance. This at the same time will limit the ways that the front hatch can be swiveled into the open state. For these embodiments, the invention provides the advantage that due to the possibility to increase the distance between the first point of connection and the second point of connection due to the operation of the actuator, the front hatch can be moved away from the coupler head into a position where it is more easy to swivel the front hatch around the coupler head.

The mounting according to the invention has a guide that guides the movement of the second point of connection along a path when the actuator is actuated in the first operational state to increase the distance between the first point of connection and a second point of connection. Providing this guide allows the movement of the second point of connection relative to the first point of connection to be controlled. This is helpful in embodiments, where the coupler head has a complex 3-dimensional shape and the front hatch has a corresponding complex shape of its parts facing the coupler. Providing a guide that guides the movement prevents that the front hatch hits the coupler head during this movement. Furthermore, given the weight of a front hatch, providing a guide to guide the movement of the second point of connection also provides the possibility to take up weight. This facilitates the design of the actuator that can be designed to primarily provide the means for setting the distance between the first point of connection and the second point of connection and needs not to be designed in a way to take up loads in directions that are not in line of its movement.

According to a first aspect of the invention, the mounting has a releasable lock that in the locked state holds a part of the guide in a predetermined position relative to the first point of connection and in the unlocked state allows the part of the guide to move relative to the first point of connection. This aspect of the invention allows for the most simply way of realizing the invention. Once the front hatch has been moved by the actuator into a position, where the distance to the first point of connection defines a radius of a rotational path on which path the front hatch swiveling about the first point of connection does not hit any element of the car of the train and especially no element of the coupler head, the front hatch can be simply released to swivel about the first point of connection. If the front hatch is intended to swivel about a vertical axis, the front hatch can then be actively swiveled around the coupler head by hand or by additional drive means. If the front hatch is designed to swivel about a horizontal axis, releasing the releasable lock can allow for the front hatch to swivel downwards and into a position below the coupler head by its own weight.

In a second aspect of the invention, a further guide is provided that guides movement of the second point of connection along a further path after the actuator has increased the distance between the first point of connection and the second point of connection to a second distance and while the distance between the first point of connection and the second point of connection is kept constant or is decreased or is increased. This embodiment provides more control over the movement of the front hatch. While in the above described aspect of the invention, the front hatch is simply let loose to swivel about the first point of connection, the second aspect of the invention makes use of the fact that the second point of connection is already guided in a guide and in a preferred embodiment simply prolongs the guide namely in the direction that the front hatch should move once it has been moved in a position that is clear of the coupler head. In one embodiment of the second aspect of the invention, the further guide keeps the distance between the first point of connection and the second point of connection constant. In this embodiment, the front hatch will swivel about the first point of connection along a path with a constant radius. In a second embodiment of the second aspect of the invention the distance between the first point of connection and the second point of connection is decreased. This allows the front hatch to move along a path that has the shape of a part of an ellipse, for example. This can be advantageous in embodiments where the clearance between the coupler head and the ground is not very large, but where the parts of the coupler head that protrude the most are arranged towards the upper regions of the coupler head. In such embodiments, the front hatch swiveling around the coupler head can be brought back closer to the coupler head once it has cleared the most protruding parts of the coupler head. This can be affected by having the front hatch swivel about the first point of connection along a path with larger radius until the front hatch has cleared the most protruding parts of the coupler head and then having the front hatch travel along a path with reduced radius, which can be affected by decreasing the distance between the first point of connection and the second point of connection.

The first aspect of the invention (releasable lock) and the second aspect of the invention (further guide) can be combined. It can be advantageous to control the point in time, when the front hatch starts to move along the further guide. Therefore, in a preferred embodiment, a releasable lock is provided and is arranged at the point of transition from the guide to the further guide and will hold back the front hatch from travelling along the further guide until the releasable lock is released.

In a preferred embodiment, the actuator comprises a hydraulic or pneumatic cylinder. Such actuators provide for sufficiently strong but also sufficiently fast means of increasing the distance between a first point of connection and a second point of connection. The actuator can counteract a mechanical force which may originate from a spring. Alternatively, the actuator could comprise a gear rod, for example a gear rod with a helical gear, and an element that is driven to move along the gear rod. Further, the actuator can comprise a linear drive, a gas pressure spring or a spindle drive.

In a preferred embodiment, the guide comprises a guide rail and a connection pin guided by the guide rail, whereby the connection pin can either be connected to the front hatch or is connected to the part of the actuator that can be connected to the front hatch. The concept of the invention does not make it necessary for the second point of connection of the actuator to be directly guided in a guide rail. However, in a preferred embodiment the actuator will have a connection that is connected to the front hatch and at the same time designed to be connected to a connection pin that is guided in the guiderail. This reduces bending moments that could otherwise be created, but at the same time enhances the complexity at the second point of connection of the actuator. Alternatively, the guide guides the movement of the second point of connection indirectly, namely by the actuator being connected to the front hatch at the second point of connection and the front hatch (possibly at a point somewhat distanced apart from the second point of connection) is connected to the connection pin that is guided in the guide rail. Given that the front hatch is usually an essentially rigid body, connecting the actuator to the front hatch at a different point (the second point of connection) then the connection pin guided by the guide rail is connected to the front hatch leads to the same effect that the guide guides the movement of the second point of connection along a path when the actuator is actuated in the first operational state to increase the distance between the first point of connection and the second point of connection. Such a design can facilitate the way of connecting the actuator to the front hatch and the connection pin to the front hatch. In one embodiment, the connection pin is thus connected to the front hatch and in a different embodiment the connection pin is connected to a part of the actuator. In an alternative, it is possible to have the connection pin connected to the part of the actuator that can be connected to the point of contact or is connected to a part that is connected to the part of the actuator that can be connected to the point of contact. In such an embodiment, the connection pin would remain stationary, while the guide is moved to move relative to the connection pin.

In a preferred embodiment, the guide guides the movement of the second point of connection along a linear path when the actuator is actuated in the first operation state to increase the distance between the first point of connection and the second point of connection. This provides for a simply way to implement the invention. Especially this facilitates the design of the guide, facilitates the design of the actuator and reduces frictional forces that need to be accounted for if the guide according to an alternative embodiment guides the movement of the second point of the connection at least in part along a bend path when the actuator is actuated in the first operational state to increase the distance between the first point of connection and the second point of connection. In a further embodiment, the path can be a combination of linear section and bend section. The path along which the guide guides the movement of the second point of connection needs to be adapted to any objects that will hinder the movement of the front hatch, for example protrusions from the coupler head.

In a preferred embodiment of the above described embodiment, the bend path comprises at least a section which is not linear. The bend path can be at least partially nonlinear. The bend path or at least a section of the bend path can have the shape of an arc of constant radius or has the shape of an arc with a radius that decreases along the arc or increases along the arc.

In a preferred embodiment, a lock is provided that in the first operational state of the mounting locks the second point of connection of the actuator into a predetermined position relative to the first point of connection of the actuator. Given that the first operational state will most likely be the state where the front hatch is closed around the coupler head and thus an operational state where forces will act on the front hatch due to the air being guided along the outer surfaces of the front hatch while the train is travelling, it is advantageous to lock the second point of connection of the actuator into a predetermined position relative to the first point of connection of the actuator. Such a lock allows to take up such forces acting on the front hatch during travel more easily and also allows for the design of the actuator to be more simple as it will not have to take up these forces. The term "lock" according to the invention encompasses a lock which can be released due to movement by actuating the actuator itself, the lock defines a position for the actuator or a part of the actuator such that the second point of connection of the actuator is in a predetermined position relative to the first point of connection when the actuator is not actuated. In a preferred embodiment, the lock prevents a rotational movement in the first operational state but permits a linear movement of the hatch. The linear movement can be caused by actuating the actuator. Due to the lock a rotational movement can be prevented and the linear movement can be a translational movement only, thus the distance between the first point of connection and the second point of connection is increased along a predetermined axis. During the linear movement the lock can be still in the locked state or non-released position. After a predetermined distance has been reached, the lock can be released and a movement other than the linear movement—for example a swivel movement or a combined swivel and linear movement—guided by a guide can follow the pure linear movement.

In a preferred embodiment, the releasable lock is a latch mechanism with a latch that in the locked state engages a protrusion, for example a pin, and in the unlocked state disengages the protrusion. Such an embodiment can for example be advantageously combined with the embodiment where the guide comprises a guide rail and a connection pin. Here, the releasable lock can be a latch mechanism that holds the connection pin. Alternative embodiments of a releasable lock can for example be electromagnets that hold a metal part and then release the metal part.

In a preferred embodiment, damping means that dampen the movement of the guide relative to the first point of connection, when the part of the guide is allowed to move relative to the first point of connection in the unlocked state or when travelling along the further guide are provided. This will allow the movement of the front hatch to be better controlled.

In a preferred embodiment, the further path is a bend path that has the shape of an arc of constant radius or in that the bend path has the shape of an arc with a radius that decreases along the arc. This allows the movement of the front hatch around the coupler to be adapted to the specific design of the coupler head. In a preferred embodiment, the front hatch can even be lifted upwards again, for example towards the end of the further path. In a preferred embodiment, the further path is designed in such a manner that the front hatch will reach its lowest point while travelling along the further path and—while still travelling along the further path—is lifted upwards to a certain extent from this lowest point. For example, an embodiment is feasible, where the front hatch is allowed to swivel about the point of contact of the car about a horizontal axis and is guided to move downwards in front of the coupler head and passes below the coupler head, thereby reaching its lowest point, while the front hatch is then pulled upwards back behind the coupler head towards the end of its travel along the further path. In such an embodiment, use is made of the space between the coupler head and the ground (the rails) to move the front hatch clear of the coupler head, while at the same time pulling the front hatch back up again once it has cleared below the coupler head increases the clearance between the front hatch and the ground (the rails) to a predefined clearance.

In a preferred embodiment, the releasable lock in the unlocked state allows the part of the guide to move freely relative to the first point of connection along a path that has the shape of an arc, whereby the radius of the arc is equal to the second distance and whereby a part of the guide or a part of the actuator or a part that can be attached to the front hatch can be received by the further guide that guides the second point of connection along a path that has the shape of an arc with a radius that decreases along the arc. This embodiment makes use of the idea that the further guide needs not necessarily be designed to have a point of transition with the guide. In this embodiment, the second point is allowed to move freely along a first part of its swivel movement about the first point of connection and after having traveled freely for a predetermined section of the swivel movement is received by the further guide. If, for example, the coupler head is of a retractable design, it might be advantageous to keep the space either side of the coupler head free and have the further guide arranged at a position below the coupler head. Additionally, the further guide might need to be arranged in a position below the coupler head in order to allow the coupler head to conduct the swivel movements in a horizontal plane that are necessary, if the train goes around a bend.

The car of a train according to the invention has a front hatch and a mounting according to the invention, whereby the actuator is connected to the point of contact of the car, thereby defining a first point of connection of the actuator and the actuator is connected to the front hatch, thereby defining a second point of connection of the actuator. The point of contact of the car preferably is a point of contact with the underframe of the car.

In a preferred embodiment of the car according to the invention a coupler head is provided, whereby the front hatch is arranged to shield at least a part of the coupler head in the first operational state of the mounting. In a preferred embodiment, the coupler head has a guiding horn. Especially with coupler heads that have a guiding horn, an element exists at the coupler head that protrudes substantially from the remaining parts of the coupler head. It is especially the guiding horn that blocks movements of the front hatch around the coupler head. Thus, especially with coupler heads with a guiding horn, the mounting according to the invention provides advantageous in the sense that the front hatch is moved further away from the coupler head when the actuator increases the distance between the first point of connection and the second point of connection.

In a preferred embodiment, the car according to the invention has a lock that in the first operational state of the mounting locks the front hatch into a predetermined position. Such a lock can be used to introduce forces that are applied to the front hatch during travel and to take away these forces from being introduced into the actuator.

The method according to the invention provides for moving a front hatch of a car of a train from a first end position to a second end position. An actuator that is connected to a point of contact of the car, thereby defining a first point of connection of the actuator and is connected to the front hatch, thereby defining a second point of connection of the actuator, is actuated when the front hatch is in the first end position to increase the distance between the first point of connection and a second point of connection from a first distance to a second distance, while a guide guides the movement of the second point of connection along a predetermined path. The front hatch is set free to rotate freely about the first point of contact after the distance between the first point of connection and the second point of connection has been increased to the second distance, whereby the distance between the first point of connection and the second point of connection is either kept constant or kept constant and is then reduced after the front hatch has moved along a predetermined section of an arc and/or the front hatch is guided to move along a further path after the actuator has increased the distance between the first point of connection and a second point of connection to a second distance and while the distance between the first point of connection and a second point of connection is kept constant or is decreased.

The mounting according to the invention is preferably used in a train, whereby trains are understood to be railway-bound trains (streetcars and subway-trains also being considered as such trains) as well as magnetic railway trains or busses that travel on fixed tracks and are comprised of several cars being understood as such trains.

BRIEF DESCRIPTION OF THE DRAWINGS

Below, the invention will be described with reference to drawings that only show exemplary embodiments of the invention.

In the drawings

DETAILED DESCRIPTION

Figures 1, 2:
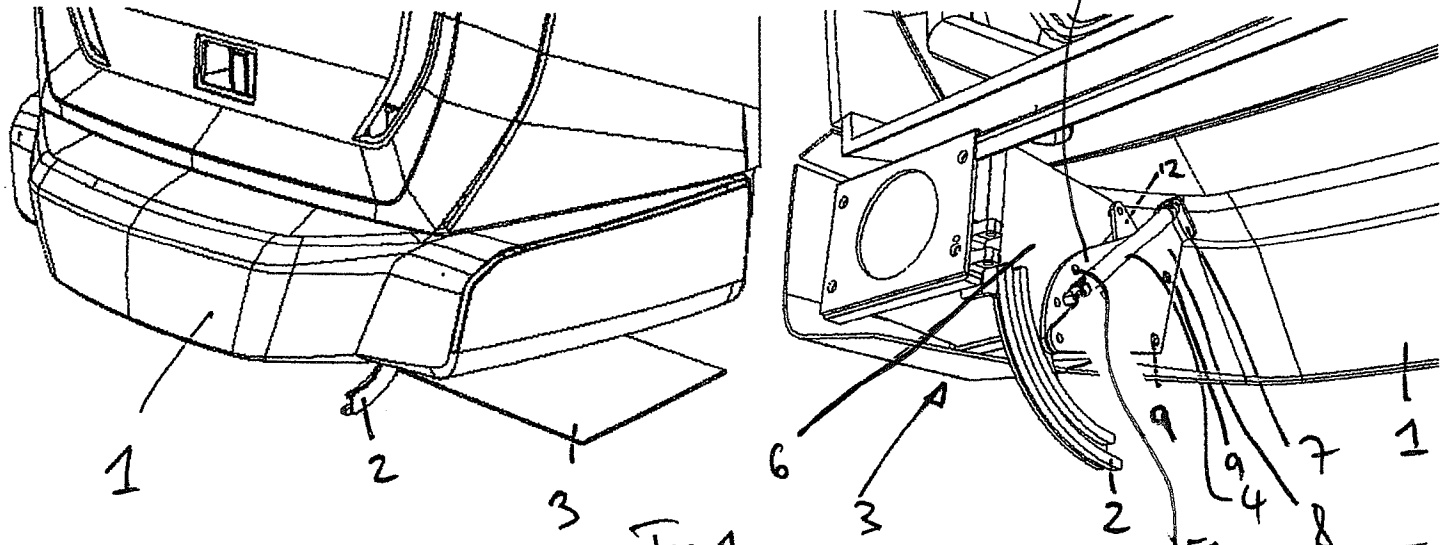
FIG. 1 shows a perspective front view onto the front end of a car of a train with a front hatch, the front hatch being in a first (closed) operational state.
FIG. 2 a partially cut perspective from below the car looking forward onto the back side of the hatch of the embodiment of the invention shown in FIG. 1.

FIG. 1 shows parts of a car of a train according to the invention with a front hatch 1 in a closed, first operational state. In this first operational state, the front hatch covers a coupler head arranged behind the front hatch. In FIG. 1, parts of a further guide 2 that will be described in more detail below can be identified. The square panel 3 shown in FIG. 1 is intended to symbolize the ground on which the train stands.

FIG. 2 shows a perspective view onto the front hatch 1 from behind, showing only parts of the hatch. The view of FIG. 2 is chosen to show the mounting of the front hatch 1 according to the invention. It is possible, that one car at one of its ends has two such mountings for a front hatch, one on each side of the car. In FIG. 2, the mounting on one side of the car is shown.

The mounting 3 of the front hatch 1 has an actuator 4 in the form of a hydraulic cylinder. The actuator 4 also has a plate-shaped element 5 and is connected to the car a point of contact 5A. The point of contact 5A is a pin that is connected to a support plate 6 connected to the underframe of the car. By way of the hinge joint (pin joint) thus provided the actuator 4 is connected to the car in such a manner that allows the actuator to rotate (swivel about the horizontal axis of the pin) relative to the point of contact 5A. The point of contact 5A with the car defines a first point of connection of the actuator 4.

Figure 6:
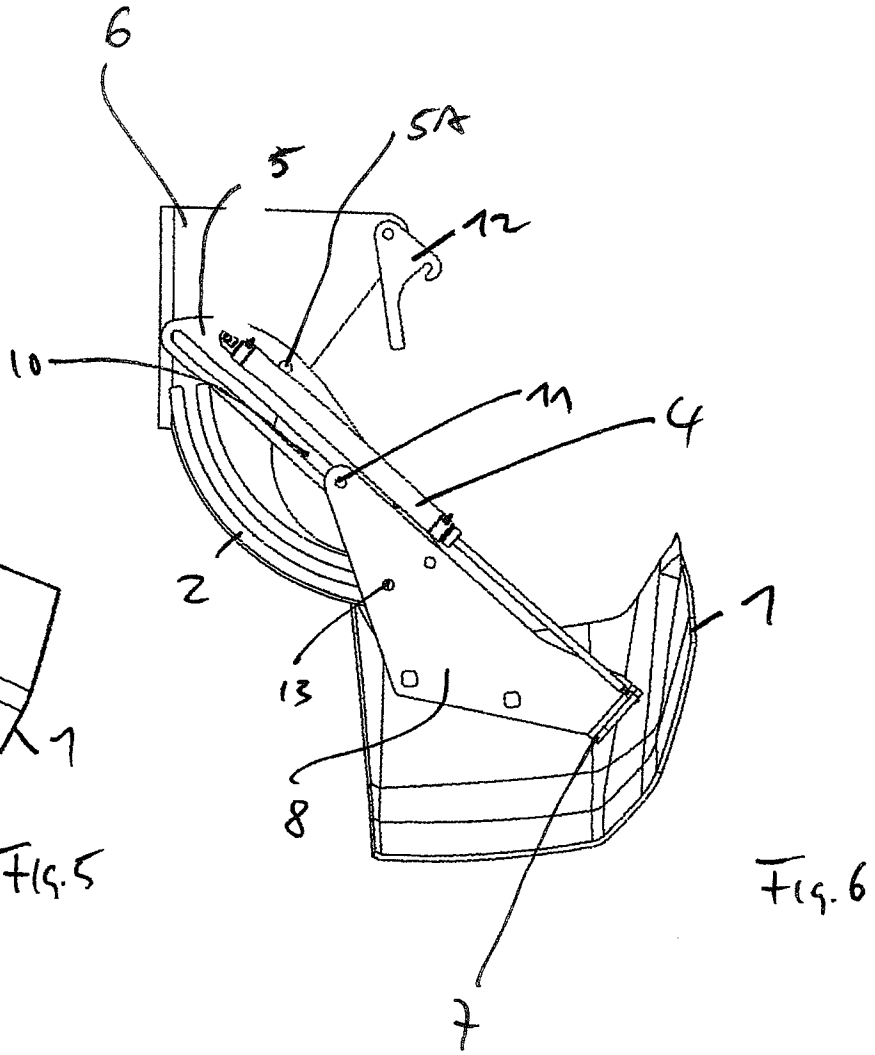
Figure 5:
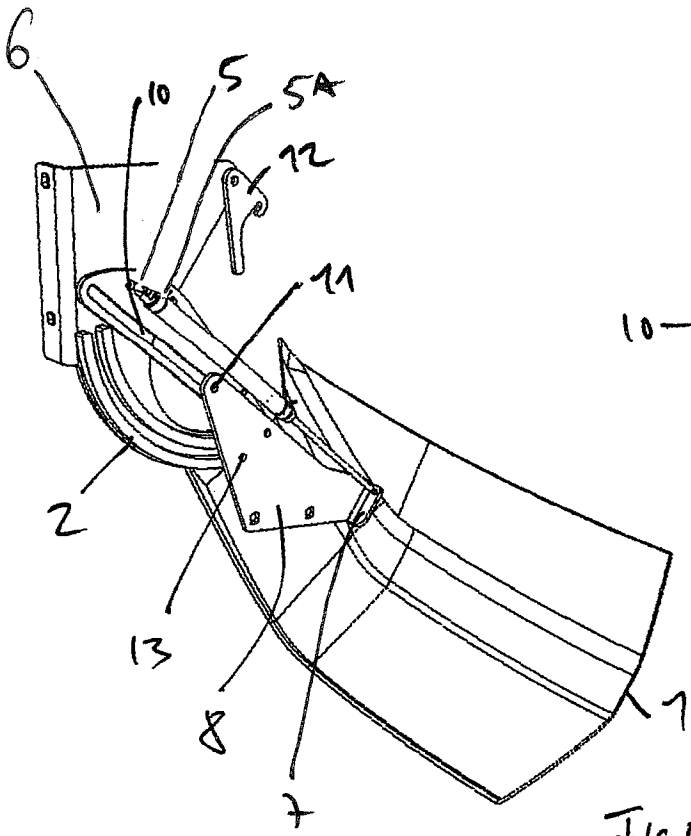
FIG. 5 a partially cut perspective view from a point of view similar to the one used for FIG. 3, now showing the front hatch in a different operational state and FIG. 6 being a partially cut side view onto the elements shown in FIG. 5.

At its opposite end, the actuator 4 is connected to a connection plate 7 that forms part of a support structure 8 of the front hatch 1. The support structure 8 is attached to the front hatch 1 by way of screws 9. The connection of the actuator 4 to the connection plate 7 defines a second point of connection of the actuator 4. In the first operational state shown in FIG. 2, 3, 4, the first point and the second point are distanced apart by a first distance. If the actuator 4 is actuated in this first operational state to increase the distance between the first point of connection to a second point of connection, the front hatch 1 moves further away from the point of contact 5A with the car. FIGS. 5 and 6 (in an operational state where the front hatch has already swiveled about the point of contact 5A) show such an operational state, wherein the first point and the second point of connection are distanced apart by a second distance.

As can be best seen in FIGS. 5 and 6, a guide 10 is provided inside the plate-shaped element 5. The support structure 8 of the front hatch 1 has a connection pin 11 that is arranged inside the guide 10. Due to the connection of the actuator 4 with the connection plate 7 and thus with the support structure 8, the guidance of the connection pin 11 in the guide 10 also provides that the second point of connection (the connection plate 7) is guided along a path by the guide 10 when the actuator is actuated in the first operational state to increase the distance between the first point of connection and the second point of connection.

A releasable lock by way of a latch mechanism that holds a pin attached to the plate-shaped element 5 that contains the guide 10. In the locked state, the releasable lock 12 holds the plate-shaped element 5 that contains the guide 10 in a predetermined state relative to the to the first point of connection (the point of contact 5A). Thus, a part of the guide is locked in a predetermined position relative to the first point of connection. In the unlocked state, the releasable lock 12 allows the plate-shaped element 5 and thus the guide 10 to move relative to the first point of connection as can be seen in FIGS. 5 and 6, where the structure that provides the guide 10 has already swiveled about the first point of connection.

Figure 4:
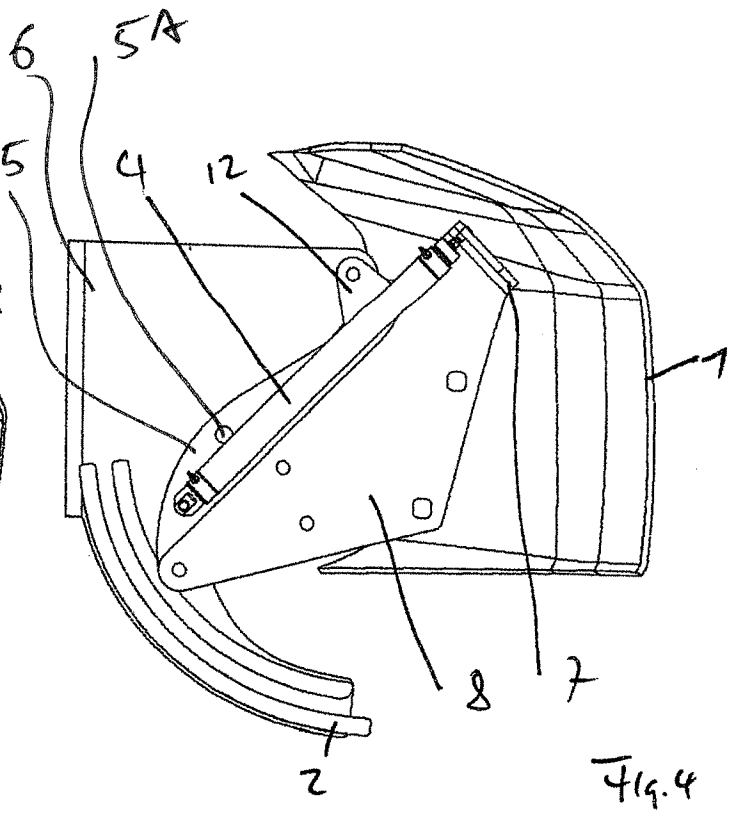
FIG. 4 a partially cut side view of the elements shown in FIG. 3.
Figure 3:
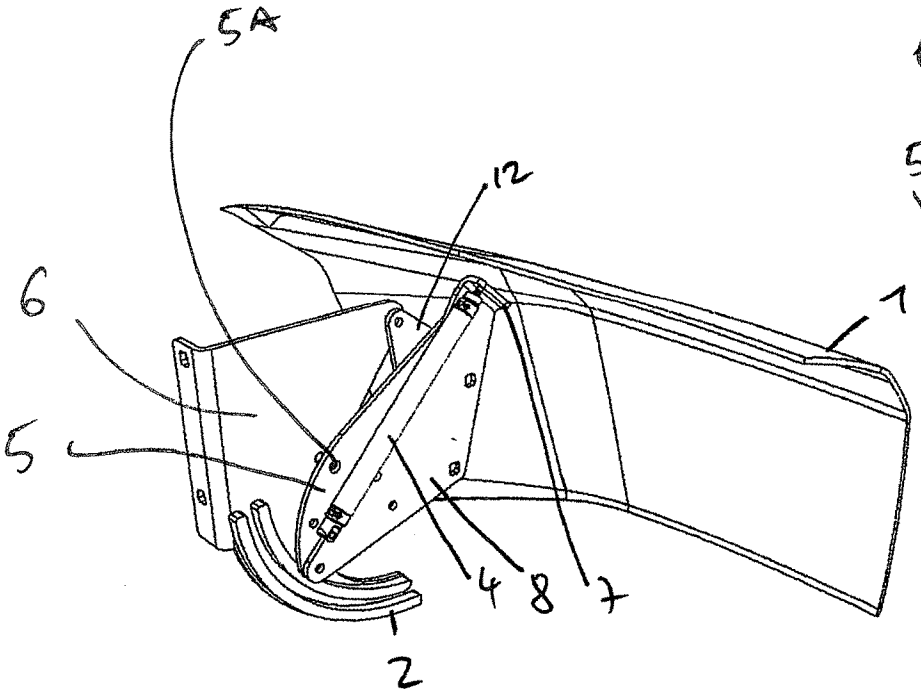
FIG. 3 a partially cut perspective view onto the front hatch and a mounting according to the invention, the perspective view being from behind looking onto the back surface of the front hatch.

The mounting according to the invention has a further guide 2 that guides the movement of the second point of connection (connection plate 7) along a further path after the actuator 4 has increased the distance between the first point of connection and the second point of connection to a second distance and while the distance between the first point of connection and the second point of connection is kept constant or is decreased. As can be understood by looking at FIGS. 3 and 4 and by looking at FIGS. 5 and 6, the front hatch in a first part of its movement can be moved away from the point of contact with the car in a linear manner provided for by the interaction of the connection pin 11 and the guide 10. The front hatch 1 will thus be lifted upwards away from a coupler head (not shown). This increase of distance between the first point of connection and the second point of connection increases the radius of a swivel movement of the front hatch 1 about the point of contact with the car. If the releasable lock 12 now releases the plate-shaped element 5 that contains the guide 10, the front hatch 1 by its own weight will swivel about the point of contact 5A of the car. It will swivel until a guide pin 13 is taken up by the further guide 2. This operational state is shown in the FIGS. 5 and 6. Here, the guide pin 13 has just been received by the further guide 2. If the actuator 4 is now activated to decrease the distance between the first point of connection and the second point of connection, the front hatch 1 will be moved along the further path provided by the further guide 2 and will be moved further upwards. This increases the clearance between the ground and the front hatch 1.

The invention claimed is:

1. An articulating mount for a moveable front hatch of a train car, comprising:

a linear actuator configured to be rotatably connected to the car at a first connection point, the linear actuator comprising a moveable end configured to be connected to the front hatch at a second connection point, the linear actuator effective, when actuated, to change a distance between the first and second connection points; and a first guide configured to be rotatably connected to the car, the first guide comprising a guide rail defining an opening sized to receive a first protrusion connected to the front hatch for guiding movement of the moveable end of the linear actuator, responsive to actuation of the linear actuator, along a first guide path between a first position and a second position.

2. The mount of claim 1, wherein the linear actuator and the first guide are fixedly connected to one another and are configured to be rotatably connected to the car about a common axis of rotation.

3. The mount of claim 1, further comprising a releasable lock, the lock including a latch sized and located to engage with a second protrusion connected to the first guide in a locked state.

4. The mount of claim 1, further comprising a second guide defining an opening sized and located to receive a third protrusion connected to the front hatch when the moveable end of the linear actuator is in the second position and the first guide has been rotated from a first predetermined angular position relative to the car.

5. The mount of claim 4, wherein the opening of the second guide defines a second guide path having a curved profile.

6. A mounting for a moveable front hatch of a train car, comprising:

an actuator configured to be rotatably connected to the car at a first connection point and including a moveable end configured to be connected to the front hatch at a second connection point, the actuator effective, when actuated, to change a distance between the first and second connection points; and a first guide configured to be rotatably connected to the car for guiding movement of the moveable end of the actuator, responsive to actuation of the actuator, along a first path between a first position and a second position.

7. The mounting of claim 6, further comprising a releasable lock configured to:

in a locked state, maintain a portion of the first guide in a first predetermined angular position relative to the car, and in an unlocked state, permit the portion of the first guide to rotate relative to the car.

8. The mounting of claim 6, further comprising a second guide configured to receive a protrusion connected to the front hatch when the moveable end of the actuator is in the second position and the first guide has been rotated from a first predetermined angular position relative to the car.

9. The mounting of claim 8, wherein when the protrusion is received by the second guide, movement of the moveable end of the actuator from the second position toward the first position guides the protrusion along a second path.

10. The mounting of claim 9, wherein the second path comprises an arcing path having a constant radius.

11. The mounting of claim 9, wherein the second path comprises an arcing path having a decreasing radius from a first path end to a second path end.

12. The mounting of claim 6, wherein rotation of the first guide relative to the car provides movement of the second connection point along an arcing path.

13. A mounting for a front hatch of a train car, which front hatch is moveable relative to a first connection point that forms part of the car, comprising:

an actuator configured to be connected at the first connection point in a manner that allows the actuator to rotate relative to the first connection point, and configured to be connected to the front hatch at a second connection point, wherein in a first operational state of the actuator, the first connection point and the second connection point are spaced apart by a first distance, wherein the actuator can be actuated to increase the distance between the first connection point and the second connection point;

a first guide that guides the movement of the second connection point along a path when the actuator is actuated in the first operational state to increase the distance between the first connection point and the second connection point; and wherein the mounting further comprises at least one of:

a releasable lock that in the locked state holds a part of the first guide in a predetermined position relative to the first connection point and in the unlocked state allows the part of the first guide to move relative to first connection point; and a second guide that guides the movement of the second connection point along a further path after the actuator has increased the distance between the first connection point and the second connection point to a second distance and while the distance between the first connection point and the second connection point is kept constant or is decreased.

14. The mounting of claim 13, wherein the first guide comprises a guide rail and a connection pin guided by the guide rail, the connection pin configured to be connected to the front hatch.

15. The mounting of claim 13, wherein the first guide is configured to guide the movement of the second connection point along a linear path when the actuator is actuated in the first operational state to increase the distance between the first connection point and the second connection point.

16. The mounting of claim 13, wherein the mounting comprises the releasable lock and the second guide, and the releasable lock in the unlocked state allows the part of the first guide to move along a path that has the shape of an arc, wherein at least one of a part of the first guide, a part of the actuator or a part that can be attached to the front hatch, can be received by the second guide for guiding the second point of connection to move further along a path that has the shape of an arc.

* * * * *